United States Patent [19]

Nihira

[11] 4,297,944

[45] Nov. 3, 1981

[54] PRINT HAMMER DRIVING MEANS FOR IMPACT PRINTERS

[75] Inventor: Shohachi Nihira, Tanashi, Japan

[73] Assignee: Citizen Watch Co., Ltd., Tokyo, Japan

[21] Appl. No.: 66,775

[22] Filed: Aug. 15, 1979

[30] Foreign Application Priority Data

Aug. 28, 1978 [JP] Japan ..... 53-104516

[51] Int. Cl.[3] ..... B41J 9/36

[52] U.S. Cl. ..... 101/93.31; 101/93.48

[58] Field of Search ..... 101/93.23, 93.30, 93.31–93.48

[56] References Cited

U.S. PATENT DOCUMENTS

| | | | |
|---|---|---|---|
| 3,255,693 | 6/1966 | Eissfeldt et al. | 101/93.31 |
| 3,292,531 | 12/1966 | Mutz | 101/93.30 |
| 3,587,456 | 6/1971 | Jaensch | 101/93.31 |
| 3,623,429 | 11/1971 | Imahashi et al. | 101/93.31 |
| 3,795,187 | 3/1974 | Babler | 101/93.30 |
| 3,832,942 | 9/1974 | Murayoshi | 101/93.31 |
| 3,848,527 | 11/1974 | Nihira | 101/93.23 |
| 3,935,813 | 2/1976 | Matsubara | 101/93.31 |
| 4,009,655 | 3/1977 | Matsubara et al. | 101/93.31 |

FOREIGN PATENT DOCUMENTS

| | | | |
|---|---|---|---|
| 2208823 | 10/1977 | Fed. Rep. of Germany | 101/93.30 |
| 854309 | 11/1960 | United Kingdom | 101/93.31 |

*Primary Examiner*—Edward M. Coven

*Attorney, Agent, or Firm*—Birch, Stewart, Kolasch and Birch

[57] ABSTRACT

A print hammer driving means for impact printers comprising a type drum having a plurality of circumferentially arranged type characters, a plurality of print hammers and a hammer spring for moving each print hammer to the type drum for printing, a wind-up lever engaged with the print hammer for winding the hammer spring, a snatch roll for actuating the wind-up lever and an electromagnet adapted to engage the wind-up lever with the snatch roll. The wind-up lever and the snatch roll are so arranged as to engage with each other during the wind-up period in one printing cycle and to release the print hammer after the wind-up period for printing.

9 Claims, 9 Drawing Figures

PRINT HAMMER DRIVING MEANS FOR IMPACT PRINTERS

BACKGROUND OF THE INVENTION

The present invention relates to print a hammer driving means in impact printers.

In the impact printer used in a desk-top electronic calculator or an electronic cash register, the print hammer is snapped into engagement with a type character on a type drum or on a type belt to impress the type upon a recording paper disposed between the type character and an inked ribbon. In a known impact printer described in FIGS. 1 and 2 of U.S. Pat. No. 3,848,527, a hammer spring is provided for driving a corresponding print hammer and a timing member such as a rotary timing cam is provided for tensioning or winding up the spring and for releasing the print hammer.

The spring is always held in the tension state and the print hammer is released at a predetermined time, so that the hammer may be driven by the energy stored in the spring to strike the type character for printing. The spring is wound up immediately after the printing and the hammer is held in the waiting position. In the waiting position, all print hammers in the machine are forced into frictional engagement with the timing cam by the tensioned springs. Accordingly, the timing cam rotates with slipping on the hammers during operation, which entails a considerable energy loss on the power source.

Further, the frictional engagement between the timing cam and the hammer produces a harsh noise during the waiting period. It should be noted that the waiting period occupies a considerable part of one printing cycle.

In another known impact printer shown in FIG. 3 of U.S. Pat. No. 3,848,527, print hammer driving means are so arranged that power of the motor is directly transmitted to the print hammer. The impact printer is provided with a motor-driven snatch roll and print hammers are provided adjacent the snatch roll. Each hammer is caused to be engaged with the snatch roll at a predetermined time, so that the hammer may be moved to the type drum for performing the impact printing. Since the snatch roll rotates without engagement with the print hammer in the waiting period, problems of energy loss and noise are solved. However, impact force for printing varies with variation of rotational speed of the motor due to variation of voltage of power source and to variation of load in the transmission system. As a result, defective print such a irregular printing is caused. Therefore, it is necessary to use a special motor with a constant rotational speed or to provide a governor for compensating the speed variation. Consequently, the device would be increased in size and would be expensive.

The above described disadvantages are noticeable in a battery powered impact printer of a small size and low power consumption. More particularly, in the impact printer of the hammer spring deflexion type as described above, friction between the hammer and the timing cam consumes a considerable amount of electric power in the waiting period, which causes a decrease in the life time of the battery. In the snatch roll type printer, it is necessary to use a motor having a constant rotational speed. However, a battery powered motor having such a characteristics cannot be obtained at the present time. In addition, when the snatch roll engages the print hammer, a great energy is required for driving the hammer. However, it is difficult to supply such a momentary great energy to the snatch roll by means of a battery powered motor.

SUMMARY OF THE INVENTION

The main object of the present invention is to provide an impact printer of a low power consumption.

Another object of the present invention is to provide a print hammer driving means for impact printers which is quiet in operation and has a high quality printing performance.

According to the present invention, there is provided a print hammer driving means comprising a rotably mounted type drum having a plurality of columns, a plurality of type characters arranged circumferentially spaced from each other for each column, a plurality of print hammers provided to be moved toward said type drum, each of said print hammers having a print head corresponding to each column, a hammer spring provided to bias each print hammer toward said type drum, a positioning spring adapted to bias said print hammer toward a waiting position, a member for deflecting said hammer spring, a power roll engageable with said member for deflecting said hammer spring, electromagnatic means for bringing said member into engagement with said power roll, means for rotating said power roll and said type drum in a predetermined rotational ratio, means for actuating said electromagnetic means at a predetermined timing, and means for releasing said print hammer at a printing time, whereby said member is actuated by engagement with said power roll for a predetermined period to deflect said hammer spring and after said predetermined period said print hammer is released to be moved to said type drum by said deflected hammer spring.

In accordance with the present invention, since the wind-up of the deflection of each hammer spring is carried out only for a predetermined energy-storing period in one printing cycle, energy loss and noise caused by friction between the hammer and the timing cam are not effected in the waiting period. The impact force in printing is decided by the stored energy in the hammer spring and the value is constant, whereby a uniform printing may be obtained. Further, a battery powered motor having a small power can be used to operate the device of the present invention to produce a high quality printing.

In accordance with the present invention, the hammer spring is deflected by a spring-deflecting power means and a spring-deflecting member. The spring-deflecting power means may be formed with a snatch roll and the spring-deflecting member may be a lever slidably provided adjacent the snatch roll. The lever is adapted to be brought into engagement with the snatch roll. The lever may be connected to the print hammer at one end thereof. Thus, the hammer spring may be deflected by the lever when it engages the snatch roll. A trigger means may be formed with an electromagnet and an associated armature. The armature is functionally engaged with the lever. The electromagnet is energized by a print signal to draw the armature, so that the actuation of the armature causes the lever to engage the snatch roll.

The print hammer may comprise a first hammer having a print head and a second hammer engaged with lever, both the hammers are coupled with each other and connected by the hammer spring.

These and other objects and features of the present invention will become more fully apparent from the following description with reference to the accompanying drawings.

DESCRIPTION OF THE PREFERRED EMBODIMENTS

Figure 1:
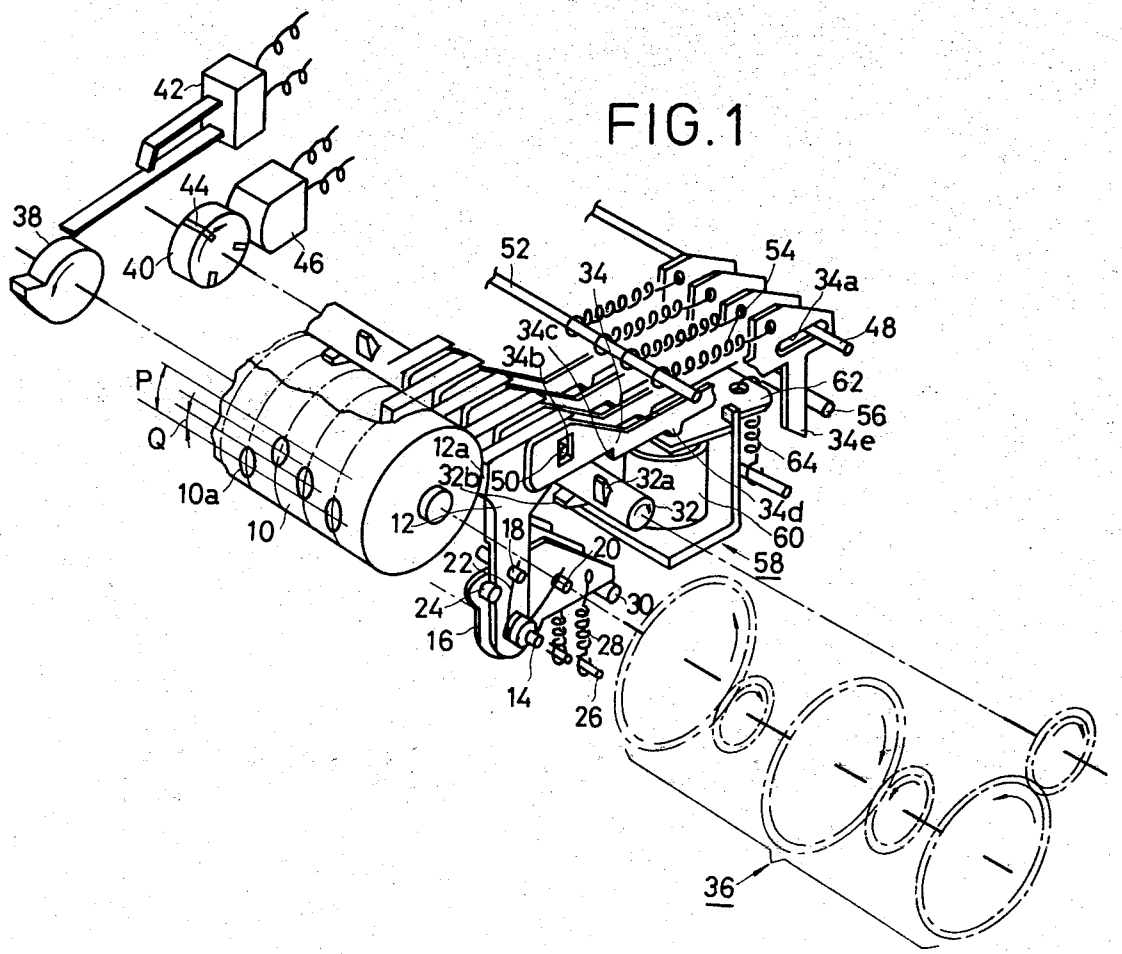
FIG. 1 is a perspective view showing an embodiment of the present invention.

Referring to FIG. 1, a type drum 10 is rotatably supported and is adapted to be driven by a battery powered motor (not shown). The type drum has a type character face 10*a* which comprises a plurality of columns of the type character. Each column has type characters comprising digits of "0" to "9" and other marks such as a plus mark. The type characters are arranged with a pitch of "P" in each column and type characters in adjacent columns are arranged with a phase difference of "Q" ($\frac{1}{3}$P). The columns of the type drum are arranged in groups each of which comprises three adjacent columns. A print hammer 12 having a print head 12*a* is rotatably mounted on a hammer shaft 14 for each column. A hammer base plate 16 is also rotatably mounted on the hammer shaft 14 adjacent each print hammer 12. One end of a hammer spring 22 engages a pin 18 secured to the print hammer 12 and the other end engages a pin 20 secured to the hammer base plate 16. The print hammer 12 is urged in the counter-clockwise direction by the spring 22 to a pin 24 secured on the base plate 16 and is yieldably engaged with the pin by a relatively small initial force of the hammer spring 22. The base plate 16 is biased to a stopper 30 by a positioning spring 28 connected between the base plate and a fixed bar 26, so that the base plate is yieldably held in engagement with the stopper 30.

In accordance with the present invention, there is provided means for deflecting and for releasing spring 22 upon printing. The means comprises a power roll such as a snatch roll 32 driven by the battery powered motor and a spring wind-up lever 34 provided for each print hammer. The snatch roll 32 is coupled to the type drum 10 through a gear train 36. The gear trains are so arranged as to rotate the type drum one pitch (P) per one revolution of the snatch roll 32. The snatch roll 32 has a plurality of teeth of which adjacent three teeth 32*a*, 32*b* and 32*c* forms a group corresponding to three columns of the said group of column and are disposed at an angular distance of 120 degree.

A start signal-generating cam 38 is secured to the shaft of the type drum 10, the cam is so disposed to actuate a switch 42 to produce a start signal at the start of a printing operation in every one revolution of the type drum. A character pulse-generating disc 40 is secured to the shaft of the snatch roll 32. The character pulse-generating disc 40 has three magnets 44 on the periphery thereof at an angular distance of 120-degree to actuate a magnetic head 46. The magnetic head 46 is so arranged to produce a character pulse at a printing timing corresponding the type character on the type drum 10.

Figure 2:
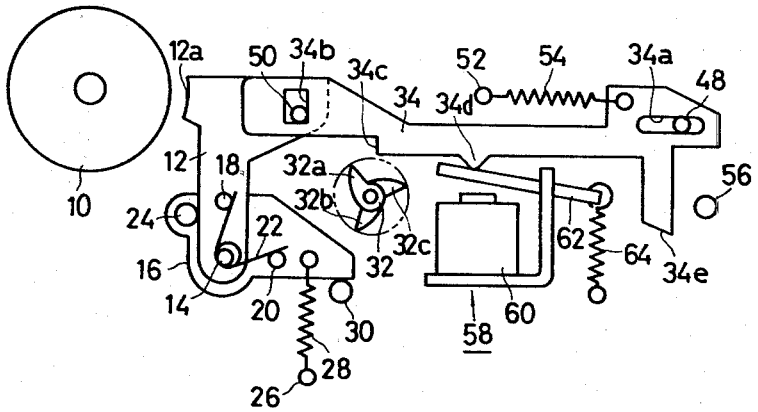
FIGS. 2 to 5 are side views for explaining the operation of the mechanism of FIG. 1.

Each spring wind-up lever 34 has a horizontally elongated hole 34*a* and a vertically elongated hole 34*b*. The horizontally elongated hole 34*a* is slidably engaged with a guiding bar 48 and the vertically elongated hole 34*b* is slidably engaged with a pin 50 secured to the print hammer 12. A spring 54 is connected between a portion of the lever 34 located above the hole 34*a* and a stationary bar 52, so that the lever 34 is biased in the counter-clockwise direction about the guiding bar 48 and at the same time biased to the hammer 12 as shown in FIG. 2. Thus, the lever 34 is held by engagement between an abutting portion 34*d* of the lever 34 and a hereinafter described armature 62, so that an engaging portion 34*c* is positioned out of the path of the tooth of the snatch roll 32. A stopper 56 is provided behind the lever 34 so as to engage with an arm 34*e* of the lever, when the lever moves rearwardly.

An electromagnetic trigger device 58 is provided for each of said column groups comprising adjacent three columns. The electromagnetic trigger device 58 comprises an electromagnet 60 and the armature 62. The armature 62 is urged in the clockwise direction by a spring 64 against the abutting portion 34*d* of the lever 34. The biasing force exerted on the lever 34 by the spring 64 is greater than the biasing force by the spring 54 and smaller than that of the positioning spring 28.

In operation, when the electromagnet 60 is de-energized the lever 34 and the hammer 12 are located in the waiting position shown in FIG. 2, where the lower edge and right edge of the hole 34*b* of the lever 34 engage the pin 50 on the print hammer and the engaging portion 34*c* is positioned out of the path of the tooth of the snatch roll 32. Accordingly, no frictional loss and noise are generated in the waiting period.

Figure 3:
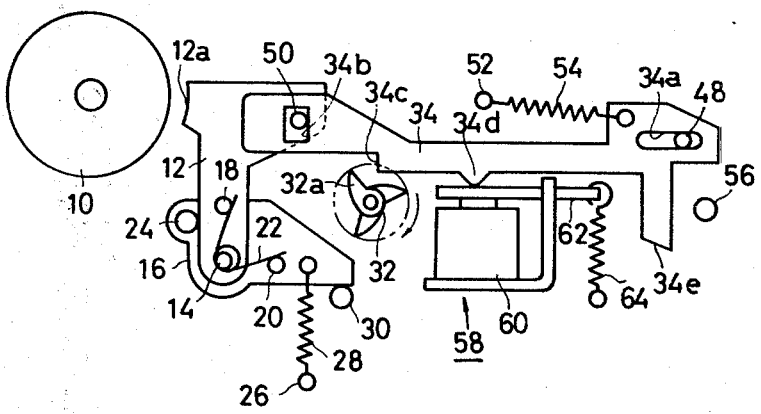
Figure 4:
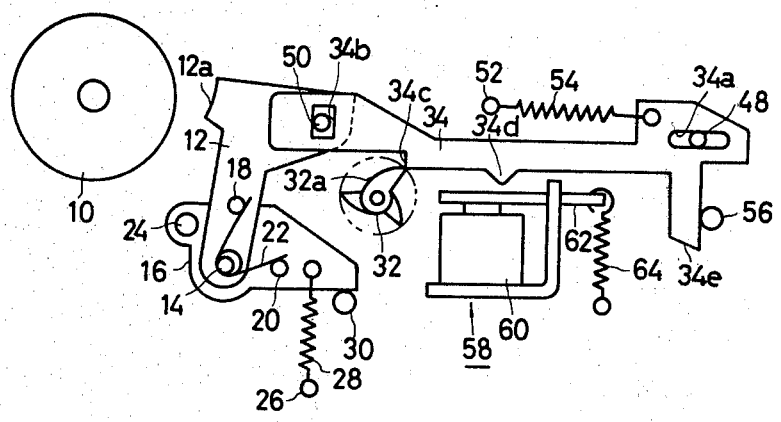

When the electromagnet 60 is energized by a printing signal, the armature 62 is drawn toward the electromagnet. As a result, the lever 34 is rotated about the guide bar 48 in the counter-clockwise direction together with the armature 62 by the spring 54, so that the engaging portion 34*c* enters into the path of the tooth of the snatch roll 32 as shown in FIG. 3. Thus, one of three teeth 32*a*, 32*b*, 32*c* in a column group engages with the engaging portion 34*c* according to the timing of the printing signal. FIG. 4 shows a state where the tooth 32*a* engages with the engaging portion 34*c*. Thus, the lever 34 is moved to the right by the tooth 32*a*, which causes the print hammer 12 to rotate about the shaft 14 in the clockwise direction. Since the base plate 16 is stopped by the stopper 30, the hammer spring 22 is wound up by the rotation of the print hammer to store the energy therein. When the arm 34 engages the stopper 56, the lever 34 rotates in the clockwise direction. At the same time, the engaging portion 34*c* disengages the tooth 32*a*. Accordingly, the engaging portion 34*c* functions as a release means and is withdrawn from the path of the tooth of the snatch roll 32, so that the print hammer 12 is released. Thus, the print hammer is rotated about the shaft 14 in the counter clockwise direction to the printing position by the hammer spring 22 accompanying with the movement of the lever 34.

Figure 5:
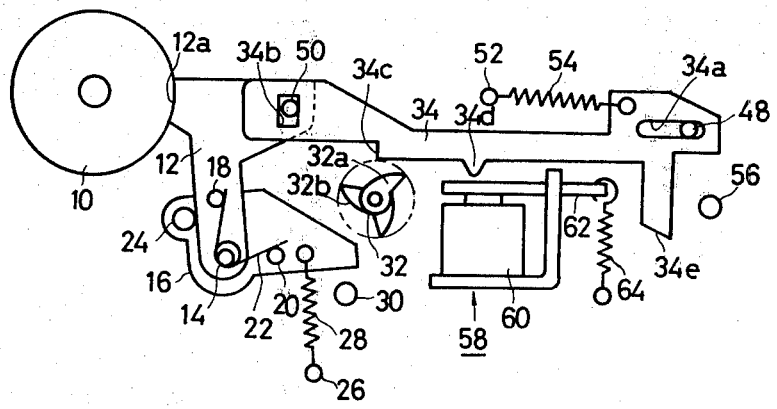

FIG. 5 shows the printing state, where the print head 12*a* of the print hammer 12 strikes the type character on the type drum 10. The print hammer 12 is rotated by the energy stored in the hammer spring 22 together with the base plate 16 against the action of the positioning spring 28 to perform the impact print. The impact force is mainly decided by the energy stored in the hammer spring 22 and the force has a fixed value. Therefore, a uniform print may be securely effected. After the printing, the print hammer 12 and the base plate 16 are returned by the positioning spring 28 and are held in engagement with the stopper 30 to thereby prevent double printing.

After completion of the printing cycle in a column, the electromagnet 60 is de-energized, so that the armature 62 returns to the initial position to bias the lever 34 upwardly. Thus, the engaging portion 34*c* is positioned out of the path of the tooth of the snatch roll 32 as shown in FIG. 2. The electromagnet 60 is energized again for printing in the next column and the above described printing operation is repeated.

It will be understood that the stopper 56 may be omitted in the above described embodiment since the engaging portion 34*c* automatically disengages from the tooth of the snatch roll at the end of the stroke of the lever 34.

Figure 6:
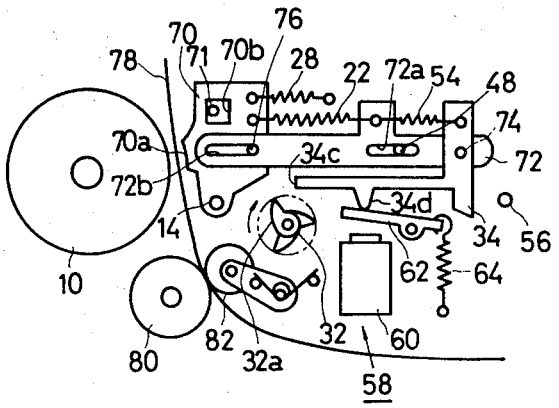
FIG. 6 is a side view showing another embodiment of the present invention.

Referring to FIG. 6, there is shown a second preferred embodiment of the present invention, in which the same parts as the device of the previous embodiment are identified with the same numerals as those of FIG. 1.

The printing mechanism of FIG. 6 is characterized in that the print hammer comprises a first hammer 70 and a second hammer 72. The first hammer 70 has a print head 70*a* and is rotatably mounted on the shaft 14. The second hammer 72 is pivotally connected to the wind-up lever 34 by a pin 74 and an elongated hole 72*a* slidably engaged with the guide bar 48. An elongated hole 72*b* of the second hammer 72 is slidably engaged with a pin 76 secured to the first hammer 70, so that both the hammers 70 and 72 may be moved relative to each other. The hammer spring 22 is connected between the hammers 70 and 72, and the spring 54 is connected between the second hammer 72 and the wind-up lever 34. A left side of an elongated hole 70*b* of the first hammer 70 is held in engagement with a fixed bar 71 by the positioning spring 28. A recording paper 78 is nipped by a feed roll 80 and a pressure roll 82 and fed by the rotation of the feed roll 80 between the type drum 10 and the first hammer 70.

In the operation of the second embodiment, in the waiting period shown in FIG. 6, the armature 62 biases the wind-up lever 34 upwardly to thereby retract the engaging portion 34*c* of the lever out of the snatch roll 32. The first hammer 70 and the second hammer 72 are maintained in the positions in FIG. 6 by positioning spring 28 and spring 54 respectively.

When the electromagnet 60 is energized in accordance with a printing signal, the armature 62 is drawn to the electromagnet, so that the engaging portion 34*c* enters into the path of the snatch roll 32. Thus, the wind-up lever 34 is moved to the right together with the second hammer to tension the spring 22. When the engaging portion 34*c* disengages the snatch roll, the second hammer 72 is flown to the left by the spring 22, and further the first hammer 70 is rotated about the shaft 14 by the second hammer 72 for printing. After printing the armature 62 returns to the initial position to thereby move the lever 34 to the waiting position.

Figure 7:
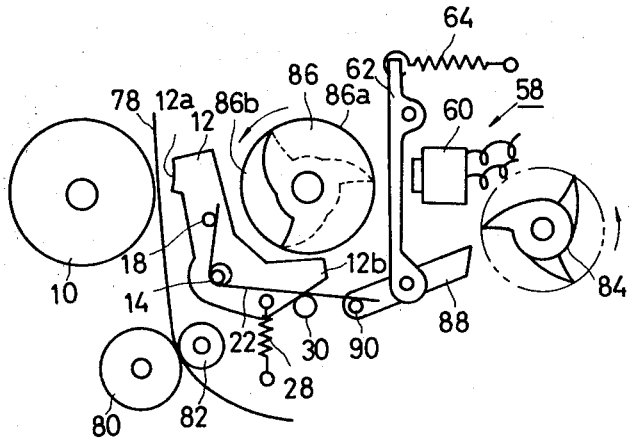
FIG. 7 is a side view showing a further embodiment of the present invention.
Figure 8:
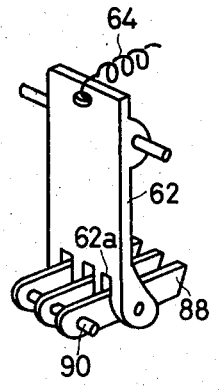
FIG. 8 is a perspective view showing a portion of an armature of the mechanism of FIG. 7.

FIGS. 7 and 8 show a third embodiment of the present invention. The device of the third embodiment is characterised in that a spring deflecting means comprises a snatch roll 84 and a timing cam 86. The snatch roll 84 is similar to the above described snatch roll 32 and is driven by the motor in the same manner as the previous embodiments. A wind-up lever 88 is pivotally connected to an end of the armature 62 and is located near the snatch roll 84.

FIG. 8 shows an armature 62 provided for adjacent three columns and three wind-up levers 88. The armature has a comb portion 62*a* for pivotally mounting the three wind-up levers. Each wind-up lever 88 has a pin 90 with which one end of the hammer-spring 22 is engaged. The armature and the levers 88 are so arranged that when the armature is drawn to the electromagnet 60, the levers 88 enter into the path of the teeth of the snatch roll 84.

The print hammer 12 is yieldably engaged with the stopper 30 by the spring 28. The hammer spring 22 is connected between the stopper 30 and the pin 18 on the hammer 12. The timing cam 86 has three cam portions on the periphery thereof for three columns at the angular distance of 180 degree and is rotated in synchronism with the snatch roll 84. Each cam portion corresponds to an engaging portion 12*b* of each hammer and comprises a protruberance 86*a* for arresting the rotation of the hammer and an indentation 86*b* for releasing the hammer.

In the waiting period, the armature 62 is biased by the spring 64 to retract the wind-up lever 88 from the snatch roll 84 and the hammer 12 is biased to the waiting position by the positioning spring 28 against the action of the spring 22 having an initial small spring force. Thus, the engaging portion 12*b* of the hammer is moved away out of the engagement with the timing cam 86.

When the electromagnet 60 is energized, the armature 62 is rotated in the counter clockwise direction, so that the wind-up lever 88 engages a tooth of the snatch roll 84 in a selected column according to the printing signal. Thus, the corresponding lever 88 is rotated clockwise by the tooth of the snatch roll to thereby wind up the spring 22, so that the hammer is biased into engagement with the timing cam 86. At the wind-up period, the engaging portion 12*b* engages the protuberance 86*a* of the timing cam 86, so that the hammer is restrained in a waiting position. Upon completion of the wind-up of the spring 22, the engaging portion 12*b* falls in the indentation 86*b*, so that the hammer 12 is rotated counter-clockwise to perform the impact printing. At the same time, the tooth of the snatch roll 84 disengages the wind-up lever 88 and the hammer 12 returns to the rest position by the positioning spring 28. Upon de-energization of the electromagnet 60, the armature 62 is returned to the home position by the spring 64 to thereby withdraw the wind-up lever 88 out of the engagement with the snatch roll 84.

Figure 9:
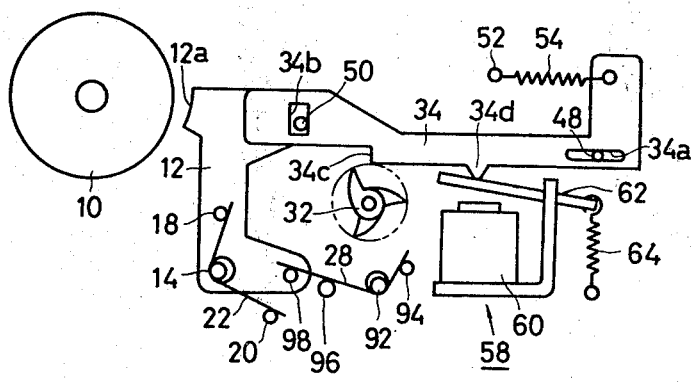
FIG. 9 is a side view showing a still further embodiment of the present invention.

Referring to FIG. 9, there is shown a fourth embodiment of the present invention. In the mechanism of the fourth embodiment, the base plate 16 in the first embodiment is omitted to simplify the construction thereof. The hammer spring 22 is connected between the pin 18 secured to the hammer 12 and the fixed pin 20. On the other hand, the positioning spring 28 is coiled around a fixed pin 92 and engages with a pin 94 and 96. One end of the positioning spring 28 is engaged with a pin 98 secured to the hammer 12. In the waiting period, the biasing force exerted on the hammer 12 by the positioning spring 28 overcomes the combined biasing force of the springs 54 and 22, so that the hammer 12 is maintained in the position of FIG. 9. Operation of the mechanism in the fourth embodiment is similar to that of the first embodiment. Therefore, the operation of the mechanism will be easily understood from that of the first embodiment.

From the foregoing, it will be understood that the present invention provides a print hammer driving means which may be operated with a small power without generating a harsh noise and may produce a uniform printing with a constant impact force.

Although the columns of the type drum and print hammers are arranged in groups and the electromagnetic trigger divide is provided for each of the groups in above described embodiments, the electromagnetic trigger device may be provided for each column of the type drum.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printer hammer driving means for impact printers, comprising:

a rotatably mounted type drum having a plurality of columns, a plurality of type characters arranged circumferentially spaced from each other for each column, a plurality of print hammers movable towards said type drum for printing, each of said print hammers having a print head corresponding to each column, a hammer spring provided to bias each print hammer towards said type drum, a positioning spring adapted to bias said print hammer towards a waiting position, a lever movable along a path for deflecting said hammer spring, a snatch roll having at least one tooth engageable with said lever for deflecting said hammer spring so as to produce an elastic force greater than the force of said positioning spring, electromagnetic means operative to hold said lever out of engagement with said snatch roll during de-energization and to bring said lever into engagement with said snatch roll upon energization, means for rotating said snatch roll and said type drum in a predetermined rotational ratio, and means for actuating said electromagnetic means at a predetermined timing, said lever and snatch roll being disposed such that said engagement therebetween disengages after a predetermined angular rotation of said snatch roll, and an elongated slot provided in said lever for permitting said lever to be reciprocated away from said type drum by said snatch roll, and a stop member being positioned to limit the reciprocal motion of said lever and to convert it to rotational motion, whereby said lever is moved by engagement with said snatch roll for a predetermined period to defect said hammer spring and after said predetermined period continued rotational movement disengages said lever from said snatch roll permitting movement of said lever and said print hammer towards said type drum by said deflected hammer spring.

2. A print hammer driving means for impact printers according to claim 1, in which said print hammer and said lever are connected with each other.

3. A print hammer driving means for impact printers according to claim 1, in which said print hammer comprises a first hammer having a print head and a second hammer connected with each other by said hammer spring, and said lever being connected to said second hammer, whereby said first hammer may be moved to said type drum together with said second hammer when said lever disengages said snatch roll.

4. A print hammer driving means for impact printers according to claim 1 in which said columns of said type drum and print hammers are arranged in groups, said electromagnetic means is provided for each of said groups.

5. A print hammer driving means for impact printers according to claim 1, said electromagnetic means including a spring biased rod which engages said lever to hold said lever out of engagement of said snatch roll during de-energization.

6. A print hammer driving means for impact printers according to claim 5, wherein upon energization of said electromagnetic means said lever is pivoted downwardly to engage said at least one tooth of said snatch roll.

7. A print hammer driving means for impact printers according to claim 1, wherein said snatch roll includes three teeth disposed at an angle of 120° with respect to each other.

8. A print hammer driving means for impact printers according to claim 1, said lever being connected to said print hammer by means of a pin secured to said print hammer and being disposed within a second slot in said lever, said second slot extending vertically permitting limited rotational motion to said lever.

9. A printer hammer driving means for impact printers, comprising:

a rotatably mounted type drum having a plurality of columns, a plurality of type characters arranged circumferentially spaced from each other for each column, a plurality of print hammers movable towards said type drum for printing, each of said print hammers having a print head corresponding to each column, a hammer spring provided to bias each print hammer towards said type drum, a positioning spring adapted to bias said print hammer towards a waiting position, a lever movable along a path for deflecting said hammer spring, a snatch roll having at least one tooth engageable with said lever for deflecting said hammer spring so as to produce an elastic force greater than the force of said positioning spring, electromagnetic means operative to hold said lever out of engagement with said snatch roll during deenergization and to bring said lever into engagement with said snatch roll upon energization, means for rotating said snatch roll and said type drum in a predetermined rotational ratio, and means for actuating said electromagnetic means at a predetermined timing, each of said printer hammers comprises a rotatably mounted first hammer having a print head and a slidably provided second hammer, said first and second hammers being coupled with each other by an engagement between an elongated hole and an engaging pin with a play therebetween and being connected with each other by said hammer spring, said lever being pivotally provided on said second hammer, said electromagnetic means comprises an electromagnet and an armature actuated by said electromagnet, said armature being engageable with said lever and so arranged to move the lever out of the path of the tooth of said snatch roll upon de-energization of said electromagnet, said lever and snatch roll being disposed such that said engagement therebetween disengages after a predetermined angular rotation of said snatch roll, whereby said lever is moved by engagement with said snatch roll for a predetermined period to deflect said hammer spring and after said predetermined period said print hammer is moved to said type drum by said deflected hammer spring.

* * * * *